United States Patent [19]

Logan, Jr.

[11] 4,257,631

[45] Mar. 24, 1981

[54] MAGNETIC EMERGENCY EXIT DOOR LOCK WITH DELAYED OPENING

[75] Inventor: Emanuel Logan, Jr., Silver Spring, Md.

[73] Assignees: Reliable Security Systems, Inc., Columbus, Ohio; Reliable Security Systems, Inc., Columbus, Ohio

[21] Appl. No.: 51,724

[22] Filed: Jun. 25, 1979

[51] Int. Cl.[3] ..... E05C 17/56

[52] U.S. Cl. ..... 292/251.5; 292/21; 292/92

[58] Field of Search ..... 292/21, 92, 144, 251.5

[56] References Cited

U.S. PATENT DOCUMENTS

| | | | |
|---|---|---|---|
| 3,431,002 | 3/1969 | Melgaard | 292/251.5 |
| 3,576,119 | 4/1971 | Harris | 292/144 X |

*Primary Examiner*—Richard E. Moore

*Attorney, Agent, or Firm*—Quaintance, Murphy & Richardson

[57] ABSTRACT

A magnetic emergency exit door locking system includes a magnetic lock with an armature securred to an emergency exit door and a coil to the lintel of the door. The coil is connected to a power supply and keeps the door locked as long as the power supply applies current thereto. A drop-out relay is disposed in the line between the power supply and coil to interrupt current to the coil when operated. The drop-out relay is operated by a switch which is tripped upon pushing the push-bar on the door. In order to prevent immediate opening of the door upon pressing the push-bar, a timer is disposed between the switch and the drop-out relay to delay unlocking of the door for a selected interval having a duration of, perhaps, fifteen (15) to forty (40) seconds. An alarm sounds during this interval to give notice that someone is trying to open the door.

7 Claims, 5 Drawing Figures

MAGNETIC EMERGENCY EXIT DOOR LOCK WITH DELAYED OPENING

RELATED PATENT APPLICATIONS

U.S. Patent Application Ser. No. 929,968, filed Aug. 1, 1978, "Emergency Exit Door Latch".

U.S. Patent Application Ser. No. 022,110, filed Mar. 20, 1979, Emergency Exit Door Locking and Latching Apparatus.

BACKGROUND OF THE INVENTION

This invention relates to an emergency exit door lock system, and more particularly this invention relates to an emergency exit door lock system wherein the system includes structure for delaying transition of the lock from a locked to unlocked mode so as to permit sounding of an alarm to give notice that the emergency exit door is being opened without authorization.

As explained in the aforecited co-pending U.S. Patent Applications, there is a need for a new type of emergency exit door lock in which opening of the lock is delayed. In the related patent applications this delay is accomplished by throttling a fluid. In order to reduce the cost of delayed action emergency exit door locks, another approach to the problem may be desirable in order to get this type of lock into wide use.

As indicated in the related patent applications, there is an inherent conflict between safety and security, even though these two concerns are interrelated. This conflict becomes readily apparent when one considers the problems encountered in trying to optimize the design of emergency exit doors. At least some doors in public buildings, such as schools, theaters, auditoriums, restaurants and the like must, by law, be equipped with latches or locks which can be readily opened from within the building should there be a fire or other emergency situation. These locks and latches pose a security problem since doors which can be readily opened from the inside of a building allow people within the buildings to easily escape with stolen articles and allow people within the buildings to open the doors and admit anyone they wish into the buildings. In the minds of security personnel, in many instances the security problems caused by easily openable emergency doors far outweigh the dangers of fire. Consequently, emergency exit doors are frequently locked with chains or other devices. This is probably done because security problems arise with greater frequency than fires and must be dealt with on a day-to-day basis, whereas fires occur infrequently and the dangers of fire are therefore ignored. If emergency exits are locked the results are often catastrophic when fires do occur and this causes fire departments great concern.

SUMMARY OF THE INVENTION

In view of the foregoing considerations, and other considerations, it is an object of the instant invention to provide a new and improved emergency exit door lock of the type which includes a delayed opening feature.

In view of the aforementioned object, and other objects, the instant invention contemplates an emergency door lock wherein the lock includes an armature of an electromagnet mounted on either a door or door jamb in opposed relation to the coil of the electromagnet, whereby the door is held shut and locked by attraction between the armature and coil as long as power is supplied to the coil. Upon interrupting power to the coil, the door becomes unlocked and may be opened by simply pushing on the door or push bar.

A drop-out relay is disposed in the line connecting the coil to its power source. The drop-out relay is operated by a timer which opens the drop-out relay a predetermined time after being started. Starting the timer is accomplished by pressing the push bar which operates a switch bar connected to the timer. Also connected within the system and operated by the emergency exit door bar is an alarm which sounds upon pressing the push-bar so as to give notice that someone is trying to open the door without authorization. As long as there is power in the system, the emergency exit door will remain locked, however, when that power is interrupted the emergency exit door will open. The system may also include a pull box, smoke or heat alarms, or other safety devices connected to the drop out relay so that when there is a fire or other emergency condition within the building, the door unlocks and can be opened.

DESCRIPTION OF THE PREFERRED EMBODIMENT

Figure 1:
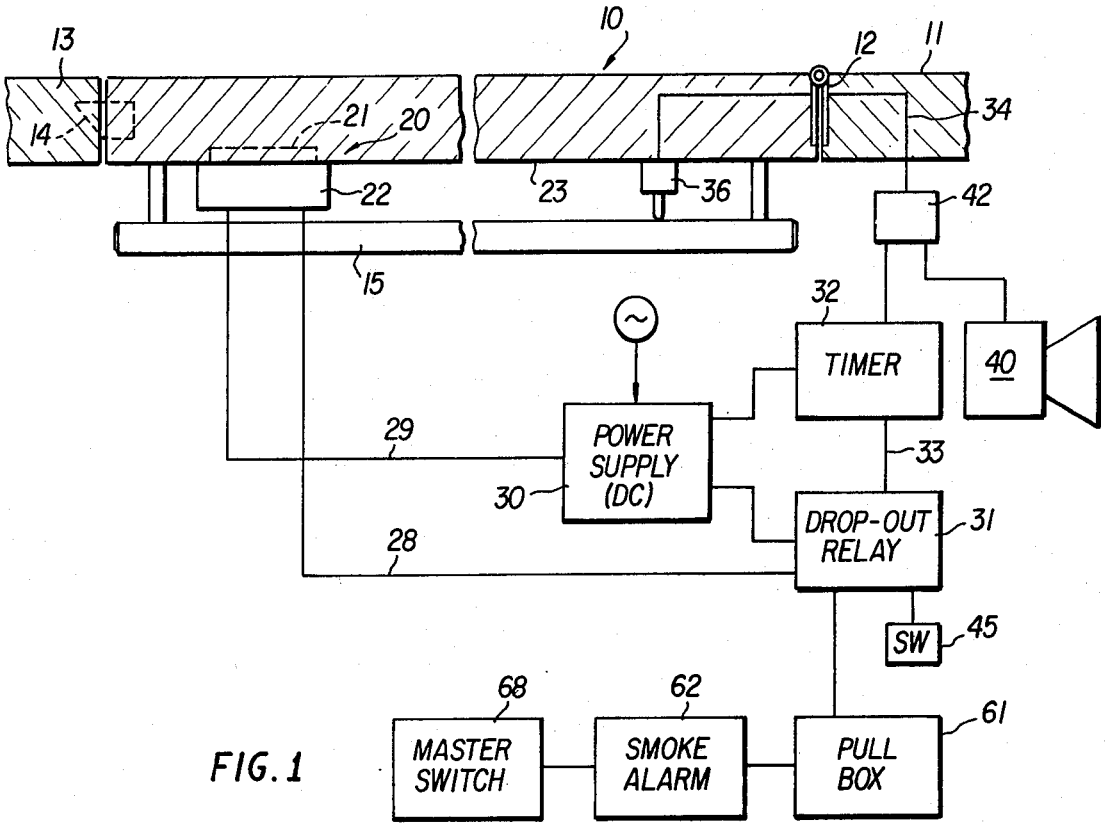
FIG. 1 is a top view of an emergency exit door having the magnetic exit door locking system according to the instant invention and showing the door in its locked and latched mode.

Referring now to FIG. 1, there is shown an emergency exit door, designated generally by the numeral 10, which is mounted in the wall of an enclosure or building on a door jamb 11 by hinges 12 (only one of which is shown) and is latched to an opposed door jamb 13 by a conventional latch bolt 14. The latch bolt 14 is retracted in a conventional manner by pushing on a push bar 15 which is connected to the bolt via any one of numerous, well known retraction mechanisms. The latch bolt 14 and the push bar 15 may be of the type shown, for example, in U.S. Pat. No. 3,663,047, incorporated herein by reference, or any other well known and widely used retraction mechanism, or may be closure operated with the bar 15 merely undogging the bolt as disclosed in related U.S. Patent Application Ser. No. 022,110, filed Mar. 20, 1979.

Figure 4:
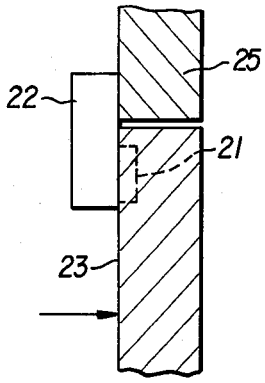
FIG. 4 is a side view showing the door held in the locked mode.

Mounted on this configuration, or a similar configuration is an electromagnetic lock, designated generally by a numeral 20, which consists of a bar of iron or armature 21 securred to the door 10 and a coil 22 mounted on the lintel 25 (see FIGS. 4 and 5) over the door. The electromagnetic lock 20 may be of any design which exerts enough force to hold the door. Typically, this force is much greater than the force necessary to retract latch bolt 14 by pushing the push-bar 15. In other words, a person within the building pushing the bar 15 will cause the latch bolt 14 to move to its retracted position, but the electromagnetic lock 20 will still hold the door closed regardless of how hard the person pushes.

The coil 22 is connected via lines 28 and 29, to a DC power supply 30 which converts normal AC line current to DC current sufficient to operate the lock 20. Disposed in the line 28 is a drop-out relay 31, which when operated, interrupts power to the magnetic lock 20 which terminates attraction between the armature 21 and coil 22, allowing the door 10 to open. The drop-out relay 31 is operated by a timer 32 that is connected via a line 34 through the hinge 12 to a switch 36. Upon depressing the push bar 15, the switch 36 is operated (either opened or closed) to start the timer 32. The timer 32 runs for a pre-determined interval and then applies a signal over line 33 to operate the drop-out relay 31 so as to open line 28. The switch 36 is also connected to an alarm 40 (via relay 42) so that when the switch is operated, the alarm sounds indicating that someone is trying to open the door 10. If desired, the alarm 40 may also include a timer (not shown) so that it does not sound until five seconds after the push-bar 40 is pressed.

In the preferred embodiment, the switch 36 closes when the bar 15 is depressed. Closing the switch 36 operates a relay 42 which connects the alarm 40 to the power supply 30 and delivers a start pulse to the timer 32. Preferably, the timer 32 is a solid state, monolithic timing circuit, such as one of those produced by several manufacturers, which can be adjusted for any desired time limit. The DC power for the timing circuit 32 is supplied by power supply 30 and the output of the timing circuit is amplified sufficiently to operate the drop-out relay 31.

Once the timer 32 is started, it will continue to run for the pre-determined time interval which may be, for example, in the range of fifteen to forty seconds. Even if the bar 15 is released, the timer 32 will continue to run. After the interval expires, the drop-out relay 31 will open and will remain open for a predetermined time, perhaps ten to thirty seconds, before again closing so as to allow current from the power supply 30 to energize the coil 22.

Preferably, the alarm 40 sounds only when the bar 15 is depressed and only when the timer 32 is holding the drop-out relay 31 open.

The foregoing discussion of preferred operation is a modification of the simple operation disclosed by the illustrated circuitry. In its elemental form, the system simply operates by closing the switch 36 so as to close the relay 42 and start the timer 32. After a pre-determined time, the timer 32 supplies a signal to the drop-out relay 31 to open the line 28 so as to unlock lock 20 and to allow the emergency exit door 10 to open. When the door is closed, the drop-out relay 31 is also closed. Closing of the drop-out relay 31 may be accomplished by a manual switch 45.

Figure 2:
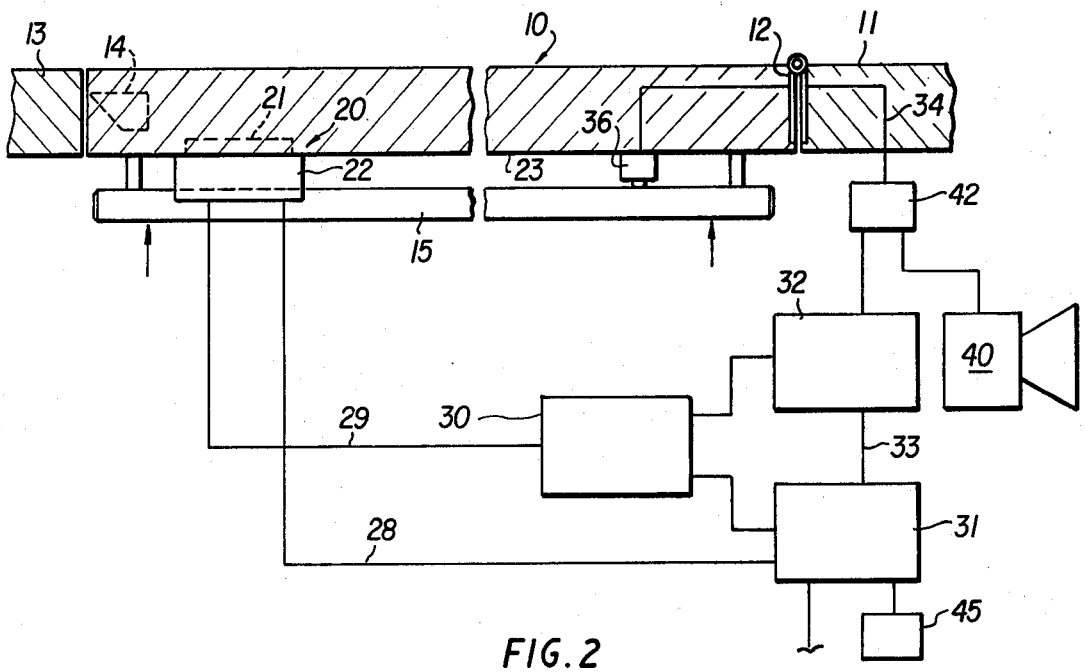
FIG. 2 is a view similar to FIG. 1 showing the emergency exit door unlatched, but still locked by the magnetic lock of the instant invention.
Figure 3:
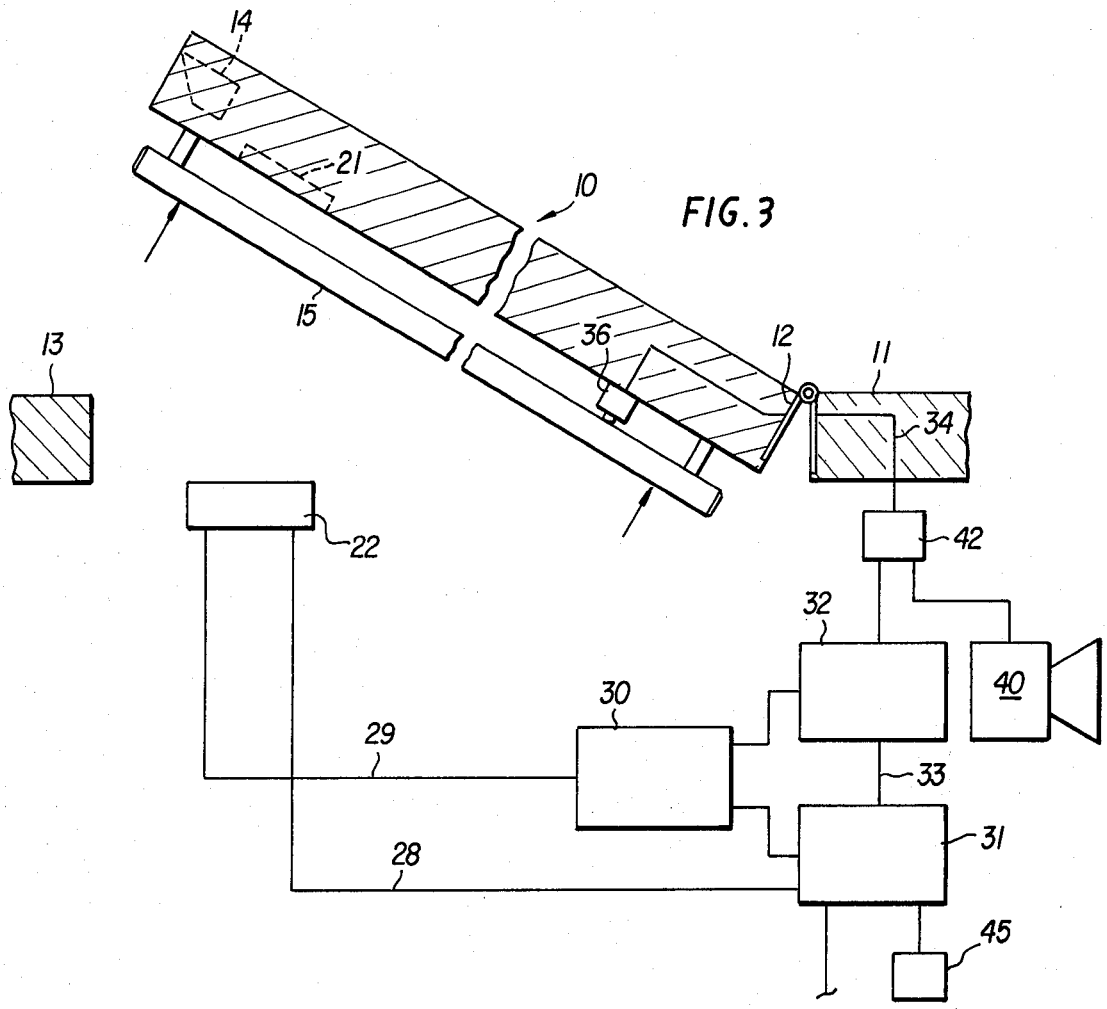
FIG. 3 is a view similar to FIGS. 1 and 2 showing the door swinging open after the magnetic lock has been deenergized and while the door is still unlatched.
Figure 5:
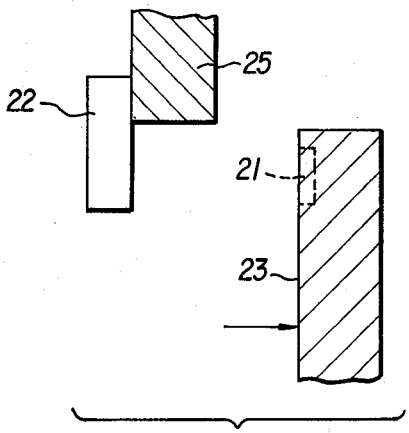
FIG. 5 is a side view showing the door opening after being switched to the unlocked mode.

The operation of the system is readily understood by reference to all of the FIGURES. FIG. 1 shows the emergency exit door 10 locked by the magnetic lock 20 and latched by the latch 14. During this time, the power supply 30 is energizing the coil 22 of the magnetic lock 20. Referring now to FIG. 2, upon pressing the bar 15, the latch bolt 14 is moved to its retracted position so as to unlatch the door 10 and the switch 36 is closed. When the switch 36 is closed, the alarm 40 is sounded and the timer 32 is started. In FIG. 2, the magnetic lock 20 is still locked because the coil 22 is energized by power supply 30. Since the alarm 40 is sounding, notice is given that someone is trying to open the door 10. Preferably, there is a remote alarm at a security station which sounds whenever the alarm 40 sounds, so as to alert security personnel that someone is trying to open the door 10. After the predetermined interval, the timer 32 causes the drop-out relay 31 to open the line 28 thereby deenergizing coil 22 and allowing the door 10 to open. The door 10 can then be opened upon pressing the push-bar 15, and will thereafter swing open as shown in FIGS. 3 and 5, allowing egress from the building.

When the emergency exit door 10 is moved from the open to the shut position, the latch bolt 14 is first cammed back to the FIG. 2 position as a cam surface 50 on the bolt 14 hits the keeper (not shown) and then spring projected to the FIG. 1 position as the bolt enters the keeper (not shown) so as to latch the door. Upon shutting the door 10, the coil 22 is reenergized either automatically or manually. If reenergized manually, the switch 45 is operated to close the drop-out relay 31. Thereafter, power supply 30 will deliver power continuously to the coil 22 to hold the door 10 locked.

Also connected to the drop-out relay 31 are conventional alarm systems, such as a pull box 61, a smoke alarm 62, and perhaps a master switch 63 located at a central security station for operating the drop-out relay 31 manually, if desired. Since the power supply 30 is operated from building AC line current, the magnetic lock 20 will open if power in the building is shut off. Consequently, the aforedescribed system provides immediate egress in the normal emergency situation and delayed egress, if for some reason, the normal emergency provisions fail. Accordingly, the instant invention resolves what used to be considered an inherent conflict between safety and security.

The aforedescribed examples and embodiment are merely illustrative of the invention which is to be limited only by the following claims:

I claim:

1. A locking system for a door of an enclosure comprising:

magnetic means for locking the door in a closed condition, wherein the magnetic means includes a coil and an armature, one of which is mounted on the door and the other of which is mounted on the enclosure;

a power supply for supplying current to the magnetic means, means for connecting the coil to the power supply wherein, when power from the power supply is supplied to the coil, the coil attracts the armature and maintains the door locked;

means disposed in the connecting means for interrupting the connecting means to thereby cut power to the armature and thereby unlock the door;

timing means connected to the interrupting means for activating the interrupting means after a time interval has expired;

switching means associated with the door for starting the timing means upon attempting to open the door, and means for permitting the door to open upon pressing thereagainst when power to the armature has been cut to unlock the door.

2. The door locking system of claim 1 further including:

an alarm;

means for sounding the alarm upon attempting to open the door.

3. A door latching and locking system for an emergency exit door for an enclosure, the system comprising:

means for latching the door in a closed condition;

means for unlatching the door to allow the door to move to an open position;

push-bar operating means connected to the unlatching means for effecting unlatching of the door;

magnetic locking means, separate from the latching means, for maintaining the door in a locked mode, even when the door is unlatched;

switch means operated upon an attempt to open the door;

timing means actuated by the switch means for providing an output after a time interval;

means connected to the timing means for interrupting operation of magnetic locking means, wherein said interrupting means is operated by the output of the timing means to open the magnetic locking means after expiration of the time interval, whereby, the door is allowed to open when unlatched.

4. The system of claim 3, wherein, the magnetic locking means includes an armature and a coil, one of which is mounted on the door and the other of which is mounted on the enclosure, to lock the door to the enclosure when the coil is energized; wherein the magnetic locking means further includes a power supply connected to the coil, and wherein the interrupting means is a drop-out relay disposed between the power supply and coil; whereby when the switch means is operated, the timing means causes the drop-out relay to drop out after the time interval has expired thereby interrupting power to the coil and unlocking the magnetic locking means.

5. The system of claim 4 further including alarm means connected to the switch means for sounding whenever the switch means is operated.

6. The system of claim 5 further including emergency situation detection means connected to the drop-out relay to open the relay when an emergency is detected.

7. The system of claim 6 wherein the power supply means is energized by line current whereby when the line current is interrupted, the power supply means does not supply current to the coil thereby unlocking the lock.

* * * * *

UNITED STATES PATENT AND TRADEMARK OFFICE

CERTIFICATE OF CORRECTION

PATENT NO. : 4,257,631

DATED : March 24, 1981

INVENTOR(S) : Emanuel Logan, Jr.

It is certified that error appears in the above-identified patent and that said Letters Patent are hereby corrected as shown below:

Column 4, line 54 (Claim 1), cancel "armature" and after "the" first occurrence insert --coil--.

Column 4, line 62 (Claim 1), cancel "armature" and insert --coil--.

Signed and Sealed this

*Twenty-third* Day of *March 1982*

[SEAL]

*Attest:*

GERALD J. MOSSINGHOFF

*Attesting Officer*

*Commissioner of Patents and Trademarks*